US010287650B2

(12) United States Patent
Schwartz

(10) Patent No.: US 10,287,650 B2
(45) Date of Patent: May 14, 2019

(54) FURNACE SYSTEM FOR THE CONTROLLED HEAT TREATMENT OF SHEET METAL PARTS

(71) Applicant: Rolf-Josef Schwartz, Simmerath (DE)

(72) Inventor: Rolf-Josef Schwartz, Simmerath (DE)

(73) Assignee: SCHWARTZ GMBH, Simmerath (DE)

( * ) Notice: Subject to any disclaimer, the term of this patent is extended or adjusted under 35 U.S.C. 154(b) by 231 days.

(21) Appl. No.: 15/333,352

(22) Filed: Oct. 25, 2016

(65) Prior Publication Data

US 2017/0037489 A1 Feb. 9, 2017

Related U.S. Application Data

(62) Division of application No. 14/003,997, filed as application No. PCT/EP2012/054139 on Mar. 9, 2012, now Pat. No. 9,493,856.

(30) Foreign Application Priority Data

Mar. 10, 2011 (EP) ..... 11157721

(51) Int. Cl.
*C21D 9/46* (2006.01)
*C21D 1/673* (2006.01)
(Continued)

(52) U.S. Cl.
CPC ..... *C21D 9/46* (2013.01); *C21D 1/34* (2013.01); *C21D 1/673* (2013.01); *C21D 9/0006* (2013.01);
(Continued)

(58) Field of Classification Search
CPC ..... C21D 2221/00
See application file for complete search history.

(56) References Cited

U.S. PATENT DOCUMENTS

2009/0320968 A1* 12/2009 Boeke ..... C21D 1/185 148/546
2011/0315281 A1* 12/2011 Charest ..... B62D 1/195 148/567
2014/0083572 A1 3/2014 Schwartz

FOREIGN PATENT DOCUMENTS

DE 10240675 5/2004
DE 10350885 6/2005
(Continued)

OTHER PUBLICATIONS

PCT/EP2012/054139 International Search Report; completed Jun. 15, 2012.
(Continued)

*Primary Examiner* — Scott R Kastler
(74) *Attorney, Agent, or Firm* — Tarolli, Sundheim, Covell & Tummino LLP

(57) ABSTRACT

The invention relates to a furnace system and a method for the controlled heat treatment of sheet metal components in individual component zones. The invention proposes a furnace system that is suitable for partly heating components made of steel sheet to a temperature above the AC3 temperature. The furnace system has a production furnace for heating the steel sheet parts to a temperature that is close to but below the AC3 temperature, said furnace system further having a profiling furnace with at least one level. The at least one level has an upper and lower part and a product-specific intermediate flange that is introduced into a corresponding receiving area. The product-specific intermediate flange is designed to impose a specified temperature profile on the component with temperatures over AC3 for regions to be hardened and below AC3 for softer regions. Furthermore, the invention relates to a corresponding method for partly heating steel sheet parts to a temperature above the AC3 temperature.

11 Claims, 2 Drawing Sheets

(51) Int. Cl.
*C21D 9/00* (2006.01)
*C21D 1/34* (2006.01)

(52) U.S. Cl.
CPC ..... *C21D 9/0062* (2013.01); *C21D 9/0068* (2013.01); *C21D 2211/008* (2013.01); *C21D 2221/00* (2013.01)

(56) References Cited

FOREIGN PATENT DOCUMENTS

| | | | |
|---|---|---|---|
| DE | 102005032113 | | 2/2007 |
| DE | 102005051403 | | 3/2007 |
| DE | 102007012180 | | 6/2008 |
| DE | 102007057855 | B3 | 10/2008 |
| DE | 102009016027 | A1 | 10/2010 |
| DE | 102009051822 | B3 | 3/2011 |
| EP | 2143808 | A1 | 1/2010 |
| WO | 2009112938 | A1 | 9/2009 |

OTHER PUBLICATIONS

PCT/EP2012/054139 International Preliminary Report on Patentability; date of completion Feb. 25, 2013.

* cited by examiner

FURNACE SYSTEM FOR THE CONTROLLED HEAT TREATMENT OF SHEET METAL PARTS

RELATED APPLICATION

This application is a divisional application of U.S. Ser. No. 14/003,997, filed on Nov. 21, 2013 that was filed under 35 U.S.C. § 371 and which is a national phase application of International Application Serial Number PCT/EP2012/054139 filed Mar. 9, 2012, (copy and English translation, attached as Appendix 1), which claims priority to European Patent Application No. EP 11157721.9, filed on Mar. 10, 2011, the disclosures of all of the above applications being incorporated herein by reference, in their entireties for all purposes.

TECHNICAL FIELD

The invention relates to a furnace system and to a method for the controlled heat treatment of sheet metal parts.

BACKGROUND ART

In the technical realm, many applications in a wide array of sectors call for high-strength sheet metal parts that are lightweight. For instance, the automotive industry is striving to reduce the fuel consumption of motor vehicles so as to lower the $CO_2$ emissions while, at the same time, improving passenger safety. For this reason, there is an ever-growing demand for autobody parts that have a favorable strength-to-weight ratio. These parts especially include A and B pillars, side-impact bars in doors, rocker panels, frame parts, bumpers, crossbeams for the floor and roof as well as front and rear longitudinal beams. In modern motor vehicles, the bodyshell with a safety cage is usually made of hardened sheet steel with a strength of about 1500 MPa. Al—Si-coated steel sheets are often used for this. The process of so-called press hardening has been developed for purposes of manufacturing parts made of hardened sheet steel. Here, steel sheets are first heated up to the austenitic temperature between 850° C. and 950° C. [1562° F. and 1742° F.], then placed into a pressing die, quickly formed and rapidly quenched by the water-cooled die to the martensitic temperature of approximately 250° C. [482° F.]. This gives rise to a hard, strong martensitic structure with a strength of about 1500 MPa. A steel sheet hardened in this manner, however, only has an elongation at break of about 6% to 8%, which is a drawback in certain areas if two vehicles collide, especially in the case of a side impact. The kinetic energy of the impacting vehicle cannot be converted into deformation heat. Rather, in this case, the part will undergo brittle fracture, additionally posing a risk of injury to the passengers.

For this reason, the automotive industry is striving to develop autobody parts that have several, different elongation and strength zones so that one single part can have very strong areas on the one hand and very extensible areas on the other hand. In this context, the general requirements made of a production installation should also be taken into account: for instance, the cycle time of the press hardening installation should not be detrimentally affected, it should be possible to use the entire installation universally without restrictions and to quickly retool it according to customer specifications. The process should be robust and cost-efficient, and the production installation should only take up a minimal amount of space. The shape and the edge precision of the part should be so high that the need for hard-trimming the hardened part is virtually eliminated, thus saving material and work.

The state of the art describes such methods and devices. In this context, these methods make use of partially heated dies, whereby one area of the part is cooled off above the martensite-forming quenching velocity. The rest of the part is cooled off abruptly as is normally done, thereby forming martensite. European publication EP 2 012 948, for example, describes a forming die for press-hardening and for the temperature-controlled forming of a blank consisting of high-strength and/or ultra-high strength steel grades; this die that has means for controlling the temperature of the forming die and this publication also describes a method for press-hardening and for temperature-controlled forming of a blank consisting of high-strength and/or ultra-high strength steel grades in which the blank is heated prior to the forming process and subsequently formed in a forming die while it is hot or warm, whereby the forming die has means for controlling the temperature. Here, several temperature-control means are provided in the forming die, as a result of which a plurality of temperature zones can be defined, whereby at least the contact surfaces of the die elements used for the forming process are associated with individual temperature zones.

German patent document DE 10 2005 032 113 discloses a device and a method for hot-working and partially hardening a part positioned between two die halves in a press. The die halves are each divided into at least two segments that are separated from each other by thermal insulation. The two segments can be heated or cooled by means of a temperature-control unit, so that different temperatures and thus different cooling curves can be established in different areas of the part. This makes it possible to manufacture a part with areas of different hardness and ductility.

International patent document WO 2009/113 938 describes a press-hardening process with which soft areas can be created in the finished product by reducing the cooling rate of these material sections. This diminishes the martensite fraction in these areas and consequently increases the elongation at break of these areas.

In this context, all of the methods that use a partially heated die entail the drawback that the part becomes warped since the part is removed from the die with partially different temperatures ranging from about 300° C. to 500° C. [572° F. to 932° F.] in the soft area, and of about 100° C. [212° F.] in the martensitic areas, after which it is further cooled away from the fixed shape of the die. Moreover, the cycle time of the process is lengthened since the fast cooling is slowed down in order to promote pearlite-ferrite formation, as a result of which the cost-effectiveness is likewise reduced. In addition, such dies are very complex and therefore expensive and malfunction-prone.

In another method known from the state of the art, for example, German patent documents DE 10 350 885, DE 10 240 675, DE 10 2005 051 403 or DE 10 2007 012 180, in a dual-zone furnace, the soft area of the part is heated up to a temperature below the material-dependent Ac3 temperature, whereas the area that is to be hardened, in contrast, is heated up to a temperature above the Ac3 temperature. In this process, an extensible soft pearlite-ferrite is formed in one area of the part and a hard martensite is formed in another area of the part. The disadvantage of this process is that the furnace can only be employed with certain limitations and can no longer serve as a universal furnace. This translates into a loss of cost-effectiveness for this method. Another disadvantage is that the separation of the areas usually cannot be accomplished with sufficient precision over the long run. Moreover, it is not feasible to implement more than two different zones. Furthermore, when Al—Si-coated parts are used, the temperature has to be kept at approximately 950° C. [1742° F.] for about 300 seconds so that the coating can diffuse into the base material. This process takes considerably longer at lower temperatures, thus reducing the cost-effectiveness of the entire installation.

Moreover, another method is known in actual practice in which the soft areas are partially cooled slowly. In this process, the entire part is heated up above the austenitic temperature beyond the diffusion time and diffusion temperature, and subsequently, either in a separate furnace or in the same furnace, it is cooled down again slowly to below the austenitic temperature in that it is partially exposed to air. When the press-hardening process is subsequently carried out in the die, the drawbacks in terms of the insufficient dimensional precision and the cost-effectiveness of the production furnace are eliminated. A disadvantage of this method is the slower cycle time caused by the additional work step. Yet another disadvantage is the undefined cooling rate that occasionally leads to martensite formation in parts that are less than 1.2 mm-thick. The cooling rate is undefined because the cooling takes place at an ambient temperature that cannot be precisely defined. For this reason, the process cannot be said to be robust. Moreover, this process can only be carried out with two zones of different hardness.

European Preliminary Published Application EP 2 143 808 A1 describes a method for the production of a shaped part having at least two structural areas of different ductility from a blank made of hardenable steel, different areas of which are heated differently and subsequently shaped in a heat-forming and hardening die and then hardened in certain areas, and also having an infrared lamp array. The blank made of hardenable steel is heated in a heating device to a homogeneous temperature that is lower than the Ac3 point of the alloy. Subsequently, the infrared lamp array is used to bring areas of the blank that are of the first type to a temperature above the Ac3 point of the alloy, and hardened in a heat-forming and hardening die in the areas of the first type. The result is a shaped part made of steel and having at least two structural areas of different ductility. The appertaining furnace system has a profiling furnace with one level, whereby the one level has an upper section and a lower section as well as a receptacle for a product-specific intermediate flange and the product-specific intermediate flange installed in it. Here, the product-specific intermediate flange is designed to impart a prescribed temperature profile to the part with temperatures above the Ac3 temperature for an area that is to be hardened and below Ac3 for a more ductile area.

Finally, German patent specification DE 10 2009 051822 B3 discloses a method for the production of shaped sheet metal parts made of high-strength steel and having partially differing strength properties in which a blank is heated up to a temperature that is higher than an Ac3 temperature, whereby the blank heated in this manner is subsequently fed into a forming die, where it is shaped and quenched, whereby it is preferably provided that partial zones of the shaped sheet part are merely annealed by controlling the temperature. In order to create a simpler and more efficient method, after being heated, the blank is partially cooled to a defined temperature, especially to a temperature below the Ac3 temperature, in an upstream conveying installation having upper and/or lower coolable conveying rollers.

Finally, it is also possible to weld different grades of steel together, so that unhardenable steel is present in the soft zones while hardenable steel is found in the hard zones. During the subsequent hardening process, the desired hardness profile is achieved over the entire part. The drawbacks of this process are the occasionally unreliable weld seam of the approximately 0.8 to 1.5 mm-thick Al—Si-coated sheet metal normally used for chassis parts, the abrupt hardness transition there as well as the increased costs of the sheet metal due to the additional production step of welding. During testing, failures occasionally occurred due to breakage in the vicinity of the weld seam, so that the process cannot be considered to be robust.

DISCLOSURE OF THE INVENTION

Before this backdrop, it is the objective of the invention to put forward a furnace system and a method for the controlled heat treatment of sheet metal parts which avoids the above-mentioned disadvantages.

The furnace system according to the invention lends itself for imparting a temperature profile to sheet steel parts, whereby a temperature above the Ac3 temperature is reached in a first area that is supposed to have an especially high hardness after the forming process, while a temperature below the Ac3 temperature is reached in a second area that is supposed to have a higher elongation at break than the first area after the forming process. In this context, it is accepted that the second area has a lower hardness than the first area.

The furnace system according to the invention has a production furnace for heating up the sheet steel parts as well as a profiling furnace in which the part can be imparted with a prescribed temperature profile at temperatures above the Ac3 for an area that is to be hardened and below Ac3 for a softer area. The profiling furnace comprises at least one level that has an upper section and a lower section as well as a receptacle for a product-specific intermediate flange and the product-specific intermediate flange installed therein. In this context, the product-specific intermediate flange is configured to impart the temperature profile to the part.

In a first embodiment, the furnace system has a conventional, universal production furnace for heating up the sheet steel parts to a temperature that is close to but below the Ac3 temperature. The profiling furnace has means to further heat up a selected area that is later going to be hardened at a temperature above the Ac3 temperature, while another area that remains less hard but that is supposed to have a higher elongation at break is kept below the Ac3 temperature.

In a second embodiment, the furnace system likewise has a conventional, universal production furnace for heating up the sheet steel parts, whereby this furnace lends itself for heating up the sheet steel parts to a temperature that is above the Ac3 temperature. For instance, the production furnace is configured to heat up the sheet steel parts at least to a diffusion temperature at which a coating diffuses deep enough into the steel matrix to later ensure corrosion resistance and good welding properties. The product-specific intermediate flange is configured to impart the part with a prescribed temperature profile at temperatures above the Ac3 temperature for areas that are to be hardened, and at temperatures below the Ac3 temperature for more ductile areas, that is to say, areas having a higher elongation at break. In this context, such more ductile areas normally have a lower hardness. For this purpose, the profiling furnace has means for maintaining a temperature above the Ac3 temperature in one selected area, while another area is brought to a temperature below the Ac3 temperature so slowly that the structure change that took place when the part was heated to the temperature above the Ac3 temperature is reversed. Here, the typical temperature gradient for the often-employed 22MnB5 steel is, for example, less than 25 K/s. With such a temperature gradient, the austenitic structure does not become a martensitic structure, but rather, it becomes a non-martensitic structure, for instance, a pearlite/ferrite structure that has a higher ductility at a lower hardness than a martensitic structure does.

In a preferred embodiment, the furnace system according to the first or second embodiment also has a positioning system on which the part can be placed in a defined position after it has been heated in the production furnace and/or in the profiling furnace. This ensures that the part is in a predefined position after it has been heated up in the production furnace or after it has been partially heated up in the profiling furnace. Then the part can be subsequently placed in a predefined position into the profiling furnace or into a press for the subsequent press-hardening process. The more precisely the placement position of the part can be adhered to, the less trimming work is needed for the finished, partially hard sheet metal part.

In an especially advantageous embodiment, the product-specific intermediate flange has means for actively cooling individual areas. In another advantageous embodiment, the cooling is effectuated by means of liquid cooling, for example, water or oil cooling.

In another particularly advantageous embodiment, the product-specific intermediate flange has means for heating an individual area or individual areas, whereby, in a special embodiment, these means are in the form of electric heaters. This makes it possible to systematically heat and/or cool individual, product-specific areas, so that the temperatures of these areas can be kept within narrow tolerance ranges. If individual areas are conveyed at a temperature above the Ac3 temperature to the subsequent press-hardening process, they become extremely hard. The other areas that undergo the press-hardening process systematically at a temperature below the Ac3 temperature will become considerably less hard and instead, they have a higher elongation at break. Electric heaters allow very precise temperature regulation.

It has been found to be advantageous for the production furnace according to the first or second embodiment to be heated by means of gas burners. This allows an especially economical heating of the parts. Since the method according to the invention in accordance with the first embodiment provides for the parts to be heated up in the production furnace only to a temperature below the Ac3 temperature and for the heat needed for heating defined areas to a temperature above the Ac3 temperature to be fed into the profiling furnace during a later process step, it is not necessary to have a very precise temperature regulation in the production furnace, so that the disadvantage of the less accurate regulation of gas burners in comparison to electric heaters is offset by the greater cost efficiency of gas as a cheaper energy carrier. This also applies to the furnace system according to the second embodiment. Here, the production furnace heats the part to a temperature above the diffusion temperature of a coating. Likewise here, there is no need for very narrow temperature regulation, provided that a temperature above the diffusion temperature is reached. More precise temperature regulation is only necessary in the next process step, in which a selected area of the part is partially cooled down to a temperature below the Ac3 temperature so slowly that the structure change that took place when the part was heated above the Ac3 temperature is reversed once again, while in another area, which is to become particularly hard later on, the temperature is kept at values above the Ac3 temperature.

In another advantageous embodiment, the furnace system according to the first or second embodiment has a production furnace which, as a continuous furnace, has a transport system to convey the parts through the production furnace. The cycle time for heating up the parts can thus be kept at the level of conventional heating furnaces used for the press-hardening process. If the subsequent process step of imparting the part with a temperature profile affects the cycle time so that the cycle time for the entire process is at risk of becoming prolonged, a profiling furnace with several levels can be employed in which the parts are partially further heated in parallel or partially in parallel. The parallel use of several profiling furnaces is also conceivable.

In order to keep the temperature tolerances on the part especially narrow during the controlled heating of individual areas, it has proven to be advantageous to regulate the temperature in a closed control circuit. For this purpose, in an advantageous embodiment, the profiling furnace has means for temperature regulation in a closed control circuit. Here, it is advantageously possible to also provide more than one control circuit.

It has proven to be particularly advantageous for the furnace system according to the first or second embodiment to also have a handling system for handling the parts. The handling system can place the parts quickly and systematically into the positioning system, can then remove them from the positioning system and can put them into the product-specific intermediate flange in the profiling furnace and take them out again. Moreover, the handling system can subsequently place the parts into a press die for the subsequent press-hardening. The use of a handling system minimizes the risk of injury to the operating personnel due to hot parts. A handling system executes the movements in defined and reproducible times, so that the parts can be placed with minimum temperature tolerances into the pressing die for the press-hardening, which has a positive effect on the quality of the part.

The method according to the invention is characterized by the following process steps:

- heating a part in the production furnace;
- positioning the heated part by means of a positioning system;
- placing the positioned part in a defined position into the profiling furnace;
- imparting a temperature profile to the part in the profiling furnace, whereby a selected area is brought to a temperature above the Ac3 temperature, while another area is brought to or kept at a temperature below the Ac3 temperature;
- removing from the profiling furnace the part that has been imparted with a temperature profile.

In this process, in a first embodiment, the part is heated up in the production furnace to a temperature close to its Ac3 temperature and the temperature profile in the profiling furnace is achieved by the controlled further heating of the selected area to a temperature above the Ac3 temperature, while another area is kept at a temperature below the Ac3 temperature.

In a second embodiment, the part is heated up in the production furnace to a temperature above the diffusion temperature and thus also above the Ac3 temperature of a coating. At the end of the requisite temperature-dependent holding time, the heated part is positioned by means of a positioning system and the thus-positioned part is placed in a defined position into the profiling furnace, where a temperature profile is imparted to it. In this process, a selected area is kept at a temperature above the Ac3 temperature, while another area is cooled down to a temperature below the Ac3 temperature so slowly that the structure change that took place when the part was heated above the Ac3 temperature is reversed. Subsequently, the part that has been imparted with a temperature profile is removed from the profiling furnace.

It has proven to be advantageous for the part to be heated up in the production furnace by means of gas burners, whereby natural gas, for example, can be employed as the energy carrier.

In another advantageous embodiment, the positioned part is brought in a defined position into the profiling furnace by means of a handling system. The advantages of this are that the risk of injury to the operating personnel is minimized and that the process is rendered more robust due to the constant handling times. An advantage here is that such a system can be retrofitted into existent installations.

Advantageously, imparting a temperature profile to the part in the profiling furnace is regulated by means of a closed control circuit. This makes it possible to achieve very narrow temperature tolerances for the part, which has a positive impact on the quality of the press-hardened part. In this context, it has proven to be advantageous if, in order to impart the temperature profile, areas of the part that are to be hardened are systematically heated up via a product-specific intermediate flange to a temperature above the Ac3 temperature, while other areas that are supposed to display a higher extensibility in the finished part are kept at a temperature below the Ac3 temperature.

Other advantages, special features and practical refinements of the invention ensue from the subordinate claims as well as from the presentation below of preferred embodiments with reference to the figure.

BRIEF DESCRIPTION OF DRAWINGS

The following is shown.

BEST MODE FOR CARRYING OUT THE INVENTION

Figure 1:
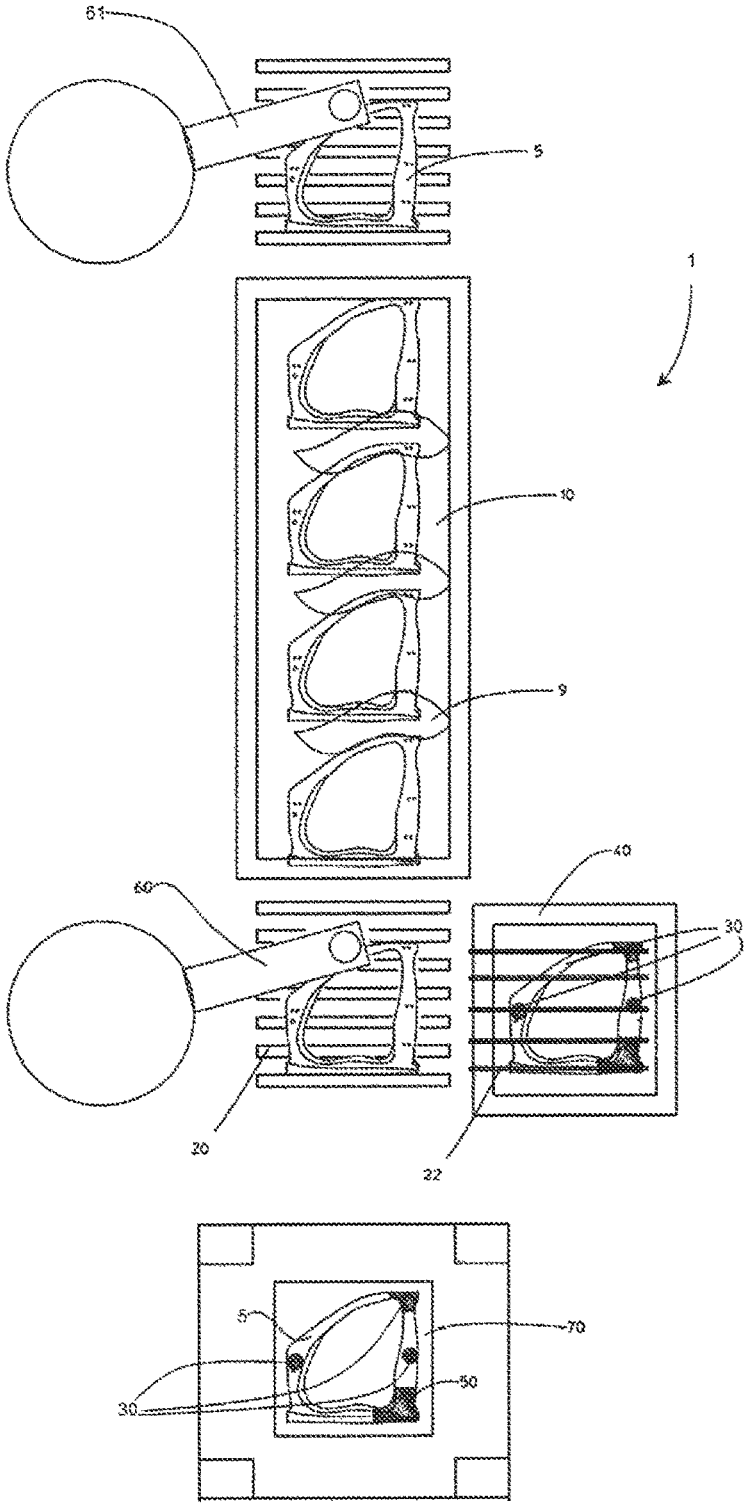
FIG. 1 a top view of the furnace system according to the invention.

FIG. 1 shows a top view of the furnace system according to the invention. A first robot 61 positions a part 5 onto a roller conveyor that transports the part 5 through the production furnace 10. The production furnace 10 is a conventional universal furnace that is heated up by natural gas burners 9 to a temperature below the Ac3 temperature of the material in question. The conveying speed for the parts 5 through the production furnace 10 is selected in such a way that the parts 5 almost reach the temperature that prevails in the production furnace 10. The production furnace 10, however, can also be heated up to a temperature above the Ac3 temperature, even above a coating-dependent diffusion temperature. In the case of the steel sheets 5 that are commonly employed, the Ac3 temperature is, for instance, 800° C. [1472° F.], whereas the diffusion temperature of Al—Si coatings is approximately 950° C. [1742° F.]. When this type of coated steel sheets 5 are employed, the steel sheets 5 can be heated up to at least 950° C. [1742° F.] in the production furnace 10 and kept at this temperature for at least 300 seconds. The throughput speed of the parts 5 through the production furnace can be selected accordingly. Downstream from the production furnace 10 in the transport direction, there is a positioning system 20 that places each part 5 in a defined flat position. A handling system 22 picks up the part 5 and places it in a defined position into the profiling furnace 40. Inside the profiling furnace 40, there is an upper section 41 and a lower section 42 as well as a receptacle 44 for a product-specific intermediate flange 45 and the product-specific intermediate flange 45 itself. The intermediate flange 45 has an area with a heater 46 on one side and an area 48 that can be cooled on the other side. In addition, it is also possible to provide the profiling furnace 40 only with means 46 for controlled heating or else only an area 48 that can be systematically cooled. In this context, such an area 48 can have cooling openings through which a cooling medium such as water or oil flows. However, it is likewise possible to employ familiar means such as heat pipes or inserts made of highly heat-conductive materials such as, for example, copper alloys, for purposes of very systematic cooling. Examples of heaters 46 that can be used are all known types of heaters such as electric heating cartridges or electric heating radiators. Electric heaters have the advantage that they can be regulated very quickly and precisely. The area 30, which is supposed to be very hard after undergoing a subsequent press-hardening process, is heated up to a temperature above the Ac3 temperature by means of the heater 46. Another area 50, which is supposed to have a higher elongation at break after the subsequent press-hardening process, is kept at a temperature below the Ac3 temperature by means of the systematic cooling 48 of this area. Especially when Al—Si-coated metal sheets that had been heated in the production furnace to at least 950° C. [1742° F.] are heat-treated, they can be after-treated in the product-specific intermediate flange 45 in such a way that the selected area 30 that is supposed to be very hard after the subsequent press-hardening process is kept at a temperature above the Ac3 temperature. Another area 50, which is supposed to have a higher elongation at break after the subsequent press-hardening process, is brought to a temperature below the Ac3 temperature so slowly by the systematic cooling 48 that the structure change of the part 5 that took place when it was heated up to the temperature above the Ac3 temperature is reversed. Here, the typical temperature gradient for the often-employed 22MnB5 steel is, for example, less than 25 K/s. At such a temperature gradient, the austenitic structure does not become a martensitic structure, but rather, it becomes a pearlite/ferrite structure. The martensitic structure is particularly hard, whereby the ductility of this structure is lower than that of the softer, non-martensitic structure. The temperature is regulated in at least one closed control circuit. At the end of the holding time needed to heat up the area 30 to the desired temperature above the Ac3 temperature, the part 5, which has now been imparted with a temperature profile, is removed from the profiling furnace 40 by means of the handling system 22. In the embodiment shown, the handling system 22 is configured as a rake. However, any other suitable handling systems can likewise be used. The handling system 22 once again places the part 5 onto the positioning system 20. However, it is likewise conceivable to place the part 5 onto another transfer station after it has been imparted with a temperature profile. A second robot 60 then takes over the part 5 in order to place it into the die 70 of a press so that it can be press-hardened. Normally, however, the part 5 can be placed directly into the pressing die 70 without being repositioned, since there is no longer any relative to movement in the profiling furnace 40 and thus no reorientation of the part 5.

Figure 2:
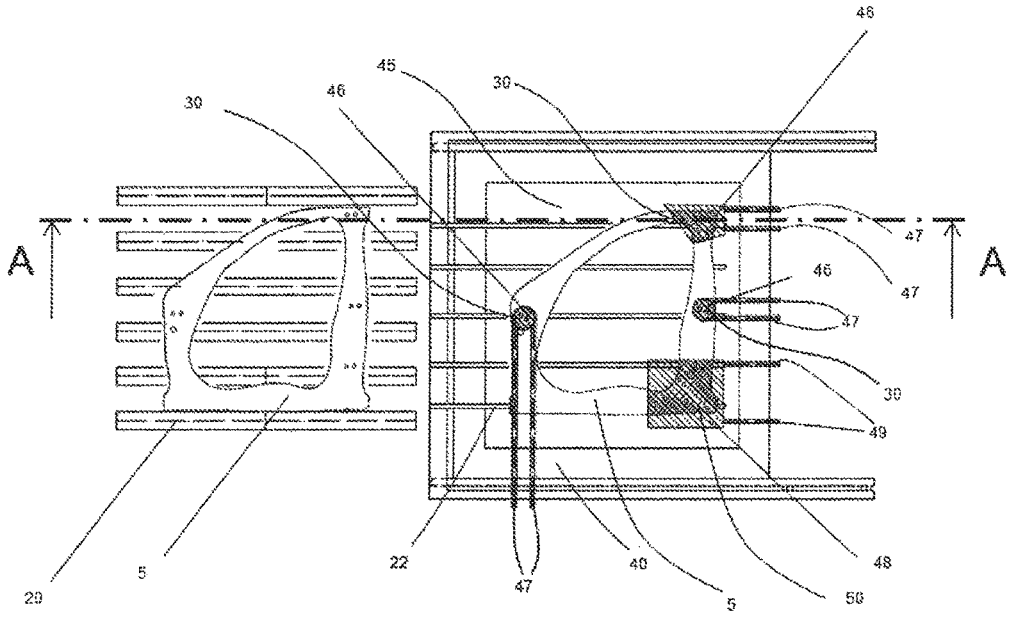
FIG. 2 a detailed view of the profiling furnace.

FIG. 2 shows a top view of the profiling furnace 40 in a detailed view. It is possible to see a part 5 that is located on the positioning system 20 in front of the profiling furnace 40. Another part 5 is inside the profiling furnace 40. Areas 30 of the part 5 that are supposed to be very hard after the press-hardening process are in the places of the product-specific intermediate flange 45 that can be heated by the heaters 46. This heater is an electric heating element that is supplied via connectors 47 with electricity made available by a regulator (not shown here). Another area 50 of the part 5 that, after the press-hardening process, is supposed to have a higher elongation at break than the hard area 30, is located in an area 48 of the product-specific intermediate flange 45 that can be systematically cooled. For this purpose, cooling medium is fed in via the connections 49 in the area 47.

Figure 3:
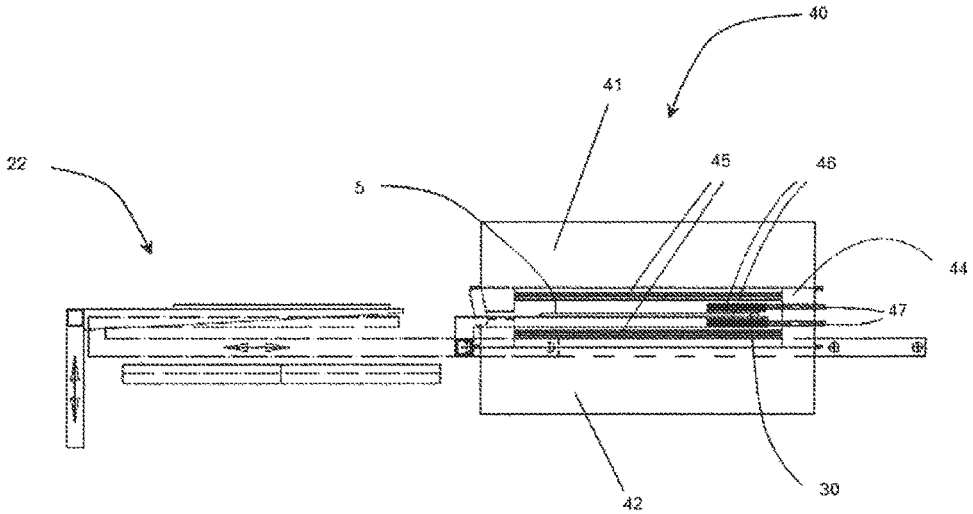
FIG. 3 section A-A from FIG. 2.

FIG. 3 shows the section A-A from FIG. 2 through the profiling furnace 40. The profiling furnace 40 has an upper section 41 and a lower section 42 as well as a receptacle 44 for a product-specific intermediate flange 45 and the product-specific intermediate flange 45 itself. Heaters 46 that are supplied with power via connectors 47 can be seen in the product-specific intermediate flange 45. In this manner, the part 5 in the area 30 can be systematically heated up to a temperature above the Ac3 temperature. Likewise visible is the handling system 22, which is situated in front of the profiling furnace 40. The arrows indicate that the handling system 22 can move a part 5 vertically and horizontally, so that a part 5 located on the positioning system 20 (not shown here) can be placed into the product-specific intermediate flange 45 inside the profiling furnace 40 by means of the handling system 22.

Instead of the above-mentioned robot, it is likewise possible to employ any other suitable handling system. In the embodiment shown in the figure, only a profiling furnace 40 with one level is described. However, it is likewise possible to have more than one level in the profiling furnace 40, whereby each level has an upper section and a lower section as well as a receptacle for a product-specific intermediate flange, so that several parts 5 can be imparted with a temperature profile in parallel or partially in parallel. By the same token, several profiling furnaces 40 can be provided in order to increase the capacity of the furnace system 1.

LIST OF REFERENCE NUMERALS

1 furnace system
5 sheet steel part, part
9 gas burner
10 production furnace
20 positioning system
22 handling system
30 hard area
40 profiling furnace
41 upper section
42 lower section
44 receptacle
45 product-specific intermediate flange
46 heater
47 connector
48 cooled area
49 cooling-water connection
50 extensible area
60 second robot
61 first robot
70 pressing die 70

Although the invention has been described with a certain degree of particularity, it should be understood that those skilled in the art can make various changes to it without departing from the spirit or scope of the invention as hereinafter claimed.

Having described the invention, the following is claimed:

1. A method for partially heating up sheet steel parts to a temperature above an Ac3 temperature, comprising the steps of:

heating a steel part in a production furnace;

placing the steel part into a profiling furnace;

imparting a temperature profile to a steel part in the profiling furnace, whereby a first area of the steel part is brought to or kept at a temperature above the Ac3 temperature and whereby a second area of the steel part is brought to or kept at a temperature below the Ac3 temperature by a product-specific intermediate flange;

removing from the profiling furnace the steel part that has been imparted with the temperature profile and wherein the product-specific intermediate flange actively cools said second area of the steel part.

2. The method according to claim 1, wherein the product-specific intermediate flange actively cools said second area of the steel part by a liquid cooling apparatus of the product-specific intermediate flange.

3. The method according to claim 1, wherein the product-specific intermediate flange actively heats said first area of the steel part.

4. The method according to claim 1, wherein the product-specific intermediate flange actively cools said second area of the steel part by a liquid cooling apparatus of the product-specific intermediate flange and wherein the product-specific intermediate flange actively heats said first area of the steel part.

5. The method according to claim 1, wherein the product-specific intermediate flange actively heats said first area of the steel part by an electric heater of the product-specific intermediate flange.

6. The method according to claim 1, wherein the product-specific intermediate flange actively cools said second area of the steel part by a liquid cooling apparatus of the product-specific intermediate flange and wherein the product-specific intermediate flange actively heats said first area of the steel part by an electric heat of the product-specific intermediate flange.

7. The method according to claim 1, further comprising the steps of:

positioning the heated steel part by a positioning system;

placing the positioned steel part in a defined position into the profiling furnace.

8. A method for partially heating up sheet steel parts to a temperature above a Ac3 temperature, comprising the steps of:

heating a steel part in a production furnace to a temperature above the Ac3 temperature;

placing the steel part into a profiling furnace having at least one level, whereby the at least one level has an upper section and a lower section as well as a receptacle for a product-specific intermediate flange and the product-specific intermediate flange installed therein;

imparting a temperature profile to a steel part in the profiling furnace, whereby one selected area that is to be hardened of the steel part is kept at a temperature above the Ac3 temperature by the product-specific intermediate flange, while another selected more ductile area of the steel part is brought to a temperature below the Ac3 temperature;

removing from the profiling furnace the steel part that has been imparted with the temperature profile wherein said selected more ductile area of the steel part is actively cooled to said temperature below the Ac3 temperature by a liquid cooling apparatus.

9. The method according to claim 8, wherein said selected more ductile area of the steel part is cooled so slowly that the structure change that took place when the steel part was heated to the temperature above the Ac3 temperature is reversed.

10. The method according to claim 8, wherein said one selected area that is to be hardened of the steel part is kept at a temperature above the Ac3 temperature by an electric heater of the product-specific intermediate flange.

11. The method according to claim 8, wherein said one selected area that is to be hardened of the steel part is kept at a temperature above the Ac3 temperature by an electric heater of the product-specific intermediate flange.

* * * * *